US005512906A

United States Patent [19]

Speciale

[11] Patent Number: 5,512,906

[45] Date of Patent: Apr. 30, 1996

[54] CLUSTERED PHASED ARRAY ANTENNA

[76] Inventor: Ross A. Speciale, 639 Camino de Encanto, Redondo Beach, Calif. 90277

[21] Appl. No.: 304,252

[22] Filed: Sep. 12, 1994

[51] Int. Cl.[6] ..... H01Q 3/22

[52] U.S. Cl. ..... 342/375

[58] Field of Search ..... 342/375, 372, 342/371, 368; 343/770, 771, 754

[56] References Cited

U.S. PATENT DOCUMENTS 5,333,001 7/1994 Profera, Jr. ..... 342/373

*Primary Examiner*—Theodore M. Blum
*Attorney, Agent, or Firm*—Leo R. Carroll

[57] ABSTRACT

An array of antenna elements is configured in a lattice-like layer, each element being similarly oriented such that the whole of the antenna elements form a homogeneous two-dimensional antenna aperture surface which can be planar or curved to conform to a desired shape. The antenna elements are connected in a one-to-one correspondence to a matching lattice of mutually similar, multiple-port, wave coupling networks physically extending behind the antenna element array as a backplane of the antenna. Each wave coupling network or "unit cell" couples signals to and/or from its corresponding antenna element and further performs as a phase delay module in a two-dimensional signal distribution network. This invention can be embodied in a conformal, or planar phased array antenna comprising a system of densely-packed resonant cavities feeding a set of resonant slot elements, both configured in an matrix array. Instead of using a corporate feed network to feed each cavity, the array is fed from points on the edges of the array, with each cavity being electromagnetically coupled to each of its adjacent cavities by common wall-coupling means. By adjusting the excitation signal amplitudes and phases at each input feed point on the perimeter, the beam may be steered off the broadside axis in any plane orthogonal to the array aperture.

20 Claims, 11 Drawing Sheets

CLUSTERED PHASED ARRAY ANTENNA

BACKGROUND OF THE INVENTION

1. Field of the Invention

This invention relates in general to electronically steered, two-dimensional, conformal, phased array antennae, and in particular to such antennae having a two-dimensional subsurface, traveling wave excitation. This invention is related to co-pending application U.S. Ser. No. 07/687/662, now U.S. Pat. No. 5,347,287, for a Conformal Phased Array Antenna, which describes an earlier embodiment of this invention.

2. Description of Related Art

Prior art in the field of electronically steered phased arrays, has mainly focused on electrically large two dimensional traveling wave arrays, with electronic beam steering in two planes and endfire beams. Such arrays are very densely populated, and include many hundreds, if not thousands, of elements. Further, in cylindrical configurations, wraparound conformal arrays physically extending 360 degrees around the cylinder axis, become possible in order to achieve at least a full hemispherical beam steering coverage of the top hemisphere, or an almost full spherical coverage. In airborn radar applications, wide off-airframe axis beam steering, close to the airframe roll plane, is actually easier to obtain from cylindrical arrays than endfire beams, as it corresponds to broadside radiation from most of the array elements. A two dimensional traveling wave array, radiating an endfire beam, planar or conformal, is somewhat equivalent to an array of Yagi-Uda arrays. Attaining such wide beam steering coverage makes many simultaneous conformal array operational functions possible, including high speed, wide volume radar target searches and multiple target tracking under severe terrain and sea clutter environments.

Examples of current phased array technology include U.S. Pat. No. 4,348,679 to Shnitkin et al, in which a single transmitter is used to generate electrical energy which is propagated through a waveguide to multiple power dividers to create branches similar to that of a corporate feed network. The novelty in Shnitkin is that an intermediate ladder configurations is used to form a front feed and a rear feed to provide excitation to the radiation elements. Each radiation element has its own feed line, resulting in a parallel configuration, which is complex, costly, and heavy. The range of beam steering in Shnitkin et al is limited to directions forward of the radiating elements, unlike this invention which, is capable of 360 degree steering because of its two-dimensional structure.

Lamberty et al, in U.S. Pat. No. 4,939,5277, disclose a distribution network for a space-fed phased array antenna comprising at least one orthogonal waveguide with a row of slots, one slot corresponding to each waveguide. The slots which provide the excitation wave feed into an electronics module which consists of a phase shifter and amplifier which are then connected to the radiating element. Each of the electronics modules is fed in parallel from the waveguide, as opposed to applicant's invention which teaches a series approach to feeding the elements with one phase shifter corresponding to each feed line so that it is associated with multiple antenna elements.

In U.S. Pat. No. 4,673,942 to Yokoyama, a multi-beam array antenna uses a matrix of feed lines, with one power feed line dedicated to each radiation element. The sole advantage of the Yokogama patent over the prior art is the introduction of delay lines in each power feed line to cause the excitation phase distribution to vary symmetrically around the center radiating element. The Yokoyama patent does not provide any simplification of the prior art by minimizing the number of feed lines within the feed network, nor does it provide for the feeding of more than one radiation element by a single feed line.

In co-pending application U.S. Ser. No. 07/687/662, a system was disclosed which includes a new feed network configuration that can be designed to physically fit within a very small internal depth below the external surface of an airframe, and to perform a load bearing structural function. A new method of array-excitation reduced the number of primary array feed lines and control elements, particularly when frequency scanning is used in one of the two beam steering planes. The broadband capabilities of tightly coupled delay structures reduce fabrication tolerance problems and make difficult broadband array applications more feasible. Finally, an optional active array architecture eliminated the need for combining transmit and receive functions in complex T/R modules, and for using one such module to feed every array element.

In the basic design underlying this co-pending invention, all the radiating elements of an electrically large, planar or conformal array antenna are mutually interconnected through a single, matrix-like, delay structure. The matrix-like delay structure extends behind the array aperture, and propagates guided waves in any direction parallel to the array antenna aperture surface. The delay structure is fed all around the array antenna aperture perimeter through a comparatively small number of peripheral input ports. The selected input ports form an excitation wave line source extending along a different segment of the array perimeter for different desired directions of the radiated beam. Electronic beam steering in a plane parallel to the array antenna aperture is obtained by controlling a small number of microwave solid state switches and phase shifters inserted along the array in external feeding lines. The switches first select the location of the set of active input ports along the array perimeter. The phase shifters then control the progressive phasing of the corresponding input signals. Because of the wave propagation properties of the underlying matrix-like delay structure, guided array-excitation waves are propagated in any desired direction parallel to the array aperture, and are dependent upon the settings of the switches and phase shifters. The radiated beam is then steered full circle in a continuous conical scan around the normal to the array aperture. Electronic beam steering in a plane orthogonal to the antenna array aperture is obtained either by frequency scanning or by electronically controlling the phase velocity of the guided array-excitation waves through the underlying delay structure. Either of these methods is physically equivalent to electronically controlling the Brewster incidence angle between the radiated beam and the guided array-excitation waves. Relatively broadband performance of electrically large planar or conformal arrays is obtained by designing the underlying matrix-like, delay structure as a tightly coupled cluster of multiport microwave resonators. Multiband performance is obtained by distributing different size array elements across the aperture in a regular pattern resulting from intermeshing at least two array lattices with different geometrical periodicity. Elements then are fed through mutually stacked independent delay structures. In an optional active architecture, two mutually stacked, matrix-like delay structures, both extending behind the antenna array aperture and having equal phase velocities, are interconnected at corresponding nodes by active, solid state amplifiers, in a two dimensional, distributed amplifier configuration. The upper delay structure is directly connected to the array antenna elements. Both delay structures perform, in turn, the functions of input and output circuit, depending on whether the array is in transmit or receive mode. Power amplifiers used in transmission are connected with the output ports towards the array elements. Low noise amplifiers used for reception are connected with the input ports towards the array elements. The two types of amplifiers are gated on and off in a mutually exclusive way.

In this underlying design, two simultaneous constraints have been implied in the choice of the relative amplitudes and of the relative phases of the microwave array-excitation signals, namely:

a) That all the external excitation signals have equal amplitudes, i.e. a 'uniform' amplitude distribution along either set of external ports.

b) That the relative phases of the microwave excitation signals injected through either set of external ports is represented by a step-wise linear progression of values, with a positive or negative constant phase difference between adjacent ports.

These tacitly implied assumptions are consistent with the simplest type of traveling-wave excitation of a two-dimensional clustered array, where a single pseudo-planar excitation wave is generated along one side of the aperture, and is made to travel across the array aperture as a single series of mutually-parallel, straight linear wavefronts oriented at some controllable angle, with respect to the rows and columns of the array elements.

With this type of traveling-wave array excitation, which is constrained by the above-formulated assumptions, electronic beam steering around the broadside direction i.e. in the direction of the equatorial angle, is obtained by controlling the direction of propagation of the traveling excitation waves. Electronic beam steering in a plane through the broadside direction in the direction of the polar angle, however, requires the electronic control of the wavelength of the excitation waves inside the cluster structure. Such control may be obtained by exploiting the cluster dispersivity by either tuning the operating frequency of the array, or by electronically tuning all the resonant array elements simultaneously, and by nominally the same amount.

SUMMARY OF THE INVENTION

This invention defines a new method for electronically scanning the beam of a clustered phased array in two mutually orthogonal planes by removal of the above mentioned constraints. This method does not require frequency scanning, and does not require the inclusion of electronic-tuning control devices, such as YIG spheres, varactors, or other form of reactance modulators in every array element.

The new beam-steering method is applicable to fixed-frequency, frequency-hopping, or spread-spectrum applications in which frequency scanning is unacceptable, and it retains the original simplicity of the new phased array concept.

By virtue of this new electronic beam steering method, an electronically steered clustered phased array may be designed as a completely passive device, with the characteristically much reduced number of beam-steering control elements totally contained within a simplified external feed network. This feed network will be computer-controlled and may have the configuration of an equal time-delay 'corporate' feed, and may include a 'Butler Matrix'. Regardless of configuration however, it will essentially include conventional microwave components, such as hybrids, phase-shifters, and signal-amplitude control devices such as variable-gain amplifiers or field-polarization rotators.

The innovative phased array concepts described herein greatly reduce system complexity, volume and weight as well as development and production costs, and make electronically steered conformal phased arrays more feasible, practical and affordable in smaller carrier airframes. They also permit higher production yields, higher reliability and readiness in all applications, and greatly simplified logistic problems.

This improvement in the above invention is based upon the observation that if the above-formulated constraints are removed so that the relative amplitudes and phases of the injected microwave signals can be freely set as needed, then any required and practically significant aperture distribution can be obtained without frequency scanning, and without electronically tuning every single array element.

This new method of electronic beam steering only requires the additional inclusion of amplitude-control devices along the path of the injected external excitation signals. A computer controlled amplitude device is added in series with the phase controller in each of the peripheral exitation input. For a rectangular matrix, each row and column has an amplitude and phase control capability. Given sufficient dynamic range for the amplitude controller, the device may also perform the row and column selection function, replacing the switches in the copending prior art design. Computer control of both amplitude and phase will permit formation of any desired waveform. In addition, requirements for the phase controller are relaxed in that a stepwise linear progression is no longer mandatory.

In addition to the above new control features, this invention also may be used with new embodiments having improved cavity and coupling means.

The prime object of this invention is to provide a new phased array antenna system with frequency independent electronic beam steering.

It is a further object of this invention to provide a new phased array antenna system with a reduced number of active elements.

It is another object of this invention to provide new phased array antenna configurations which will reduce size, ease manufacturing problems, and reduce cost.

DESCRIPTION OF THE PREFERRED EMBODIMENT

Figure 1:
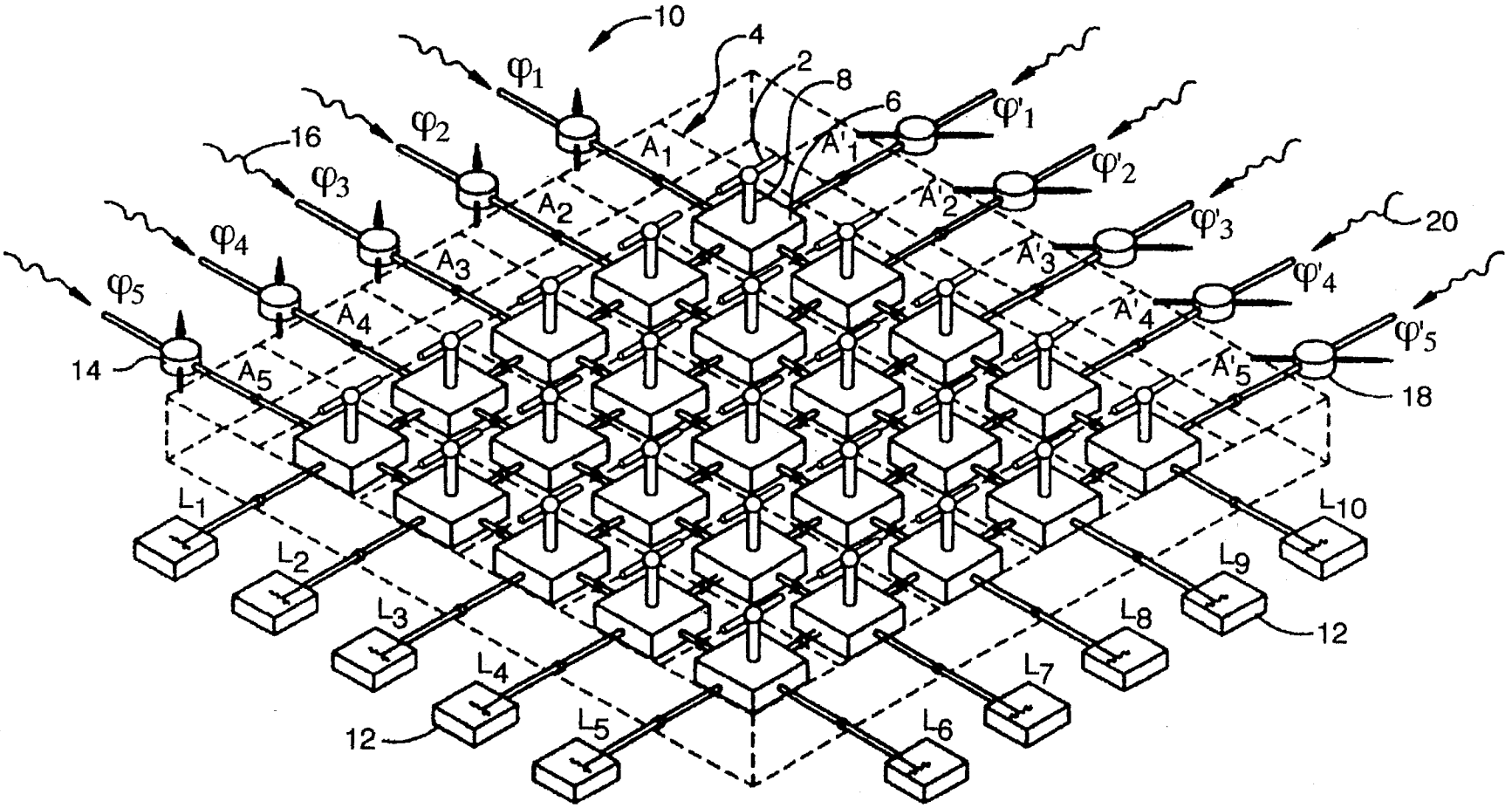
FIG. 1 is a schematic representation of a dipole version of this invention.

Referring to FIG. 1, the underlying phased array antenna architecture is illustrated as having a two-dimensional, electrically large array of antenna elements illustrated as dipoles 2. The dipoles are shown as being ordered in a single layer square lattice, a five-by-five section being shown for example. The dipoles are all similarly oriented such that the whole of the dipoles form a doubly-periodic two-dimensional antenna aperture surface 4 which can be planar or curved to conform to a desired shape. Each dipole 2 is connected to a uniquely corresponding phase delay module 6 or "unit cell" by means of an electromagnetic wave coupler 8 communicating with a first wave port of the delay module. Preferably this coupler and all others referred to in this specification comprise guided wave couplers. The unit cells are geometrically ordered in a square lattice physically co-extensive with the dipole array as a backplane of the dipole array. Except for the unit cells at the periphery of the lattice, each unit cell has four additional wave ports, each of which uniquely communicates with a neighboring unit cell. The unit cells at the periphery of the lattice each have three additional wave ports, each of which uniquely communicates with a neighboring unit cell. A fifth wave port communicates with either a source of excitation 10 or an impedance matching load 12. Configured and interconnected as such, the unit cells form a doubly-periodic, wave coupling network performing at least two functions. Each unit cell couples signals to and/or from its corresponding dipole, and the unit cells as a group perform as a phase delay structure in the form of a two-dimensional signal distribution network.

Figure 2:
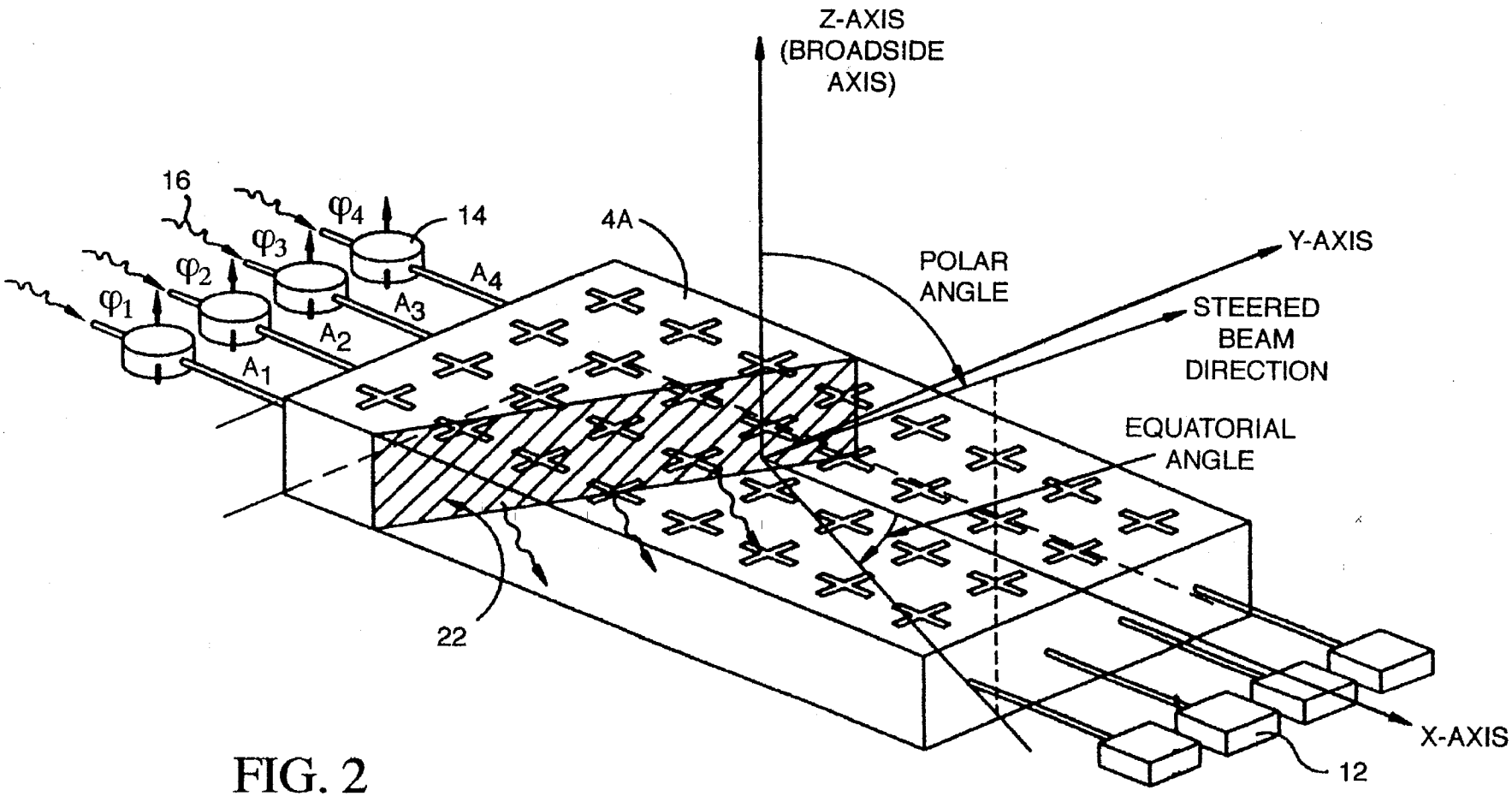
FIG. 2 is a schematic representation of row-wise excitation of an embodiment of this invention.
Figure 3:
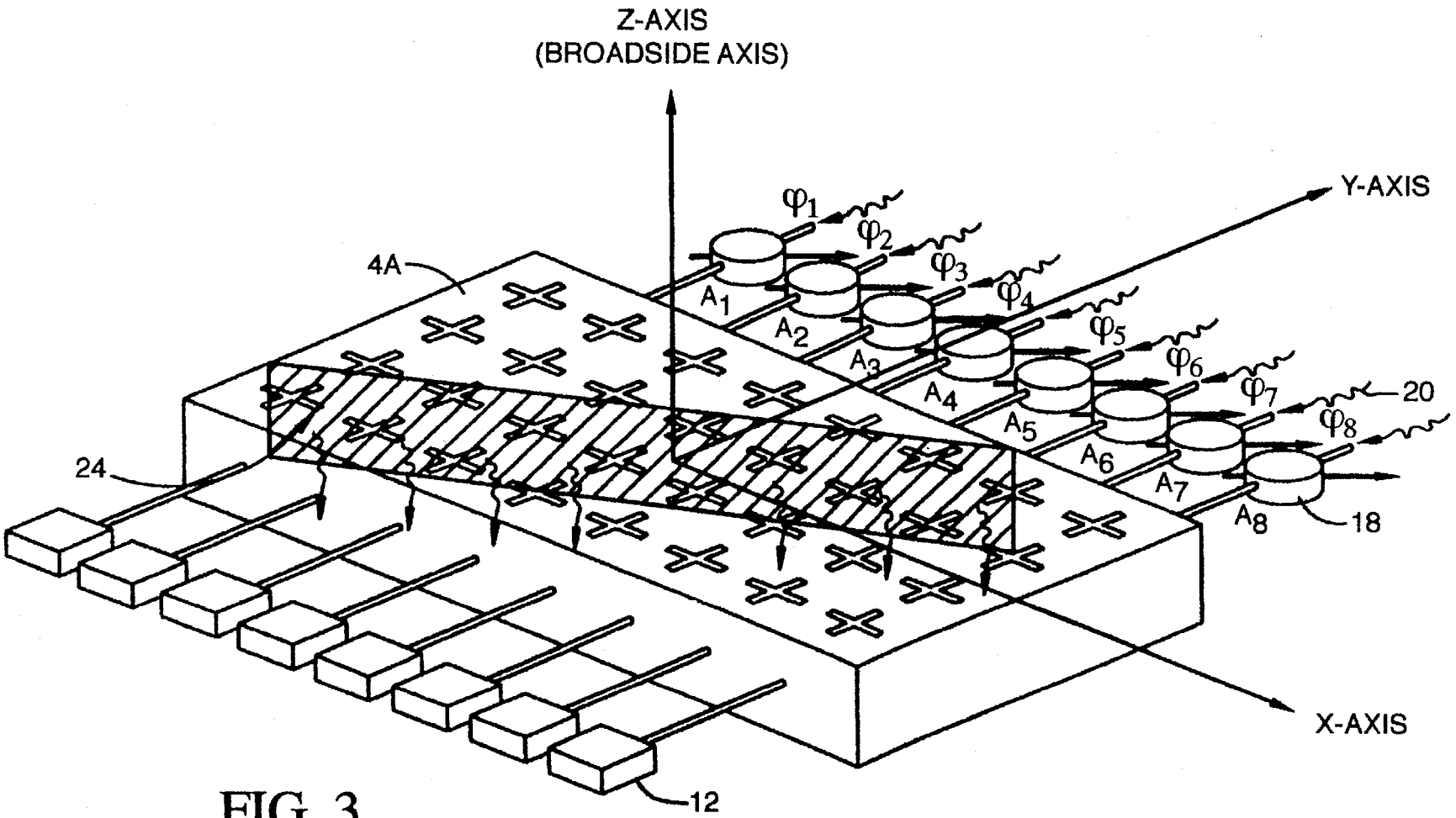
FIG. 3 is a schematic representation of column-wise excitation of the embodiment of this invention.

Referring to FIGS. 1–3, the array excitation consisting of rim feeding is illustrated. Excitation signals are applied, i.e., fed, to the unit cell array around its edges through a comparatively small number of peripheral input ports not exceeding the number of edge unit cells. The square lattice structure of the unit cells aligns them such that rows and columns can be arbitrarily assigned, and so for illustration purposes only, the lines of unit cells and their corresponding dipoles sloping downward from left to right are designated rows and the lines normal to them are designated columns. In FIG. 1, for each row of unit cells a unit cell at one end uniquely communicates with a row amplitude and phase shifter 14 which in turn selectively receives a row excitation signal 16, and produces a set of output signals $A_N$ having controlled amplitude and phase shift attributes. The unit cell at the other end of the row communicates with a load 12 (L6–L10). For each column of unit cells a unit cell at one end uniquely communicates with a column amplitude and phase shifter 18 which in turn selectively receives a column excitation signal 20 and produces a set of output signals $A'_N$ having controlled amplitude and phase shift attributes. The unit cell at the other end of the column communicates with a load 12 (L1–L5) The unit cells at the ends of the rows and columns are the peripheral units as used herein. Primary array feed lines are generally connected to all peripheral ports, but only a subset of contiguous peripheral ports need to be active at any single time, the physical location of the set depending upon the desired direction of propagation of the excitation waves through the underlying two dimensional delay structure, and upon the corresponding beam steering direction in a plane parallel to the array aperture along the equatorial angles of FIGS. 2 and 3. The direction of propagation of the excitation waves can also be determined by amplitude controlling and phasing of the external feed signals along the desired set of active input ports. The desired set will be selected by means of the amplitude control function within element 14. In operation, the backplane of unit-cells propagates guided traveling array-excitation waves, with a progressive phase from dipole element to dipole element, in any direction parallel to the antenna aperture. Under proper external excitation the internal array excitation, i.e. wavefront, spans the total width of the array, and propagates through the two-dimensional unit cell array, in any arbitrary direction parallel to the aperture. Each unit cells linearly adds a delay in the wave propagation.

The innovative concept of two dimensional subsurface traveling wave array-excitation illustrated in FIG. 1, is a conceptual extension of the well known concept of serie-fed linear array to two dimensional traveling wave phased arrays. The single one dimensional artificial delay line, that connects adjacent linear array elements is replaced by an matrix-like electromagnetic delay structure, or an "artificial delay surface", that is intrinsically image matched up to its external boundaries, and the new method of array-excitation simply amounts to series-feeding in two dimensions.

FIG. 2 illustrates a four row by eight column lattice of unit cells (not shown) with a steered beam excitation wavefront 22 traversing through the lattice at an equatorial angle determined by selective excitation of the four rows of unit cells. In this case the unit cells are coupling the excitation wave to crossed-slot antenna elements. This illustrates row-wise array excitation with linear excitation phase progression, the top row leading most and the bottom row lagging most. In the case of row-wise array excitation with equal phase excitation signals, the equatorial angle would be 0 degrees.

FIG. 3 illustrates a four row by eight column lattice of unit cells (not shown) with a steered beam excitation wavefront 24 traversing through the lattice at an equatorial angle determined by selective excitation of the eight column of unit cells. In this case also the unit cells are coupling the excitation wave to crossed-slot antenna elements. This illustrates column-wise array excitation with linear excitation phase progression, the leftmost column leading most and the rightmost column lagging most. In the case of column-wise array excitation with equal phase excitation signals, the equatorial angle would be −90 degrees. The beam steering directions as illustrated in FIGS. 2 and 3 and/or discussed above can be reversed, by injecting equal phase feed signals along the rightmost array column or along the bottom row, respectively.

It will be noted that this array design drastically reduces the notorious complexity of phased arrays, by replacing the conventional intricate voluminous heavy and costly array feed network, such as conventional corporate feed networks, with a system of short electromagnetic interconnections spanning all the very small inter-element spacings of the array.

Figure 4:
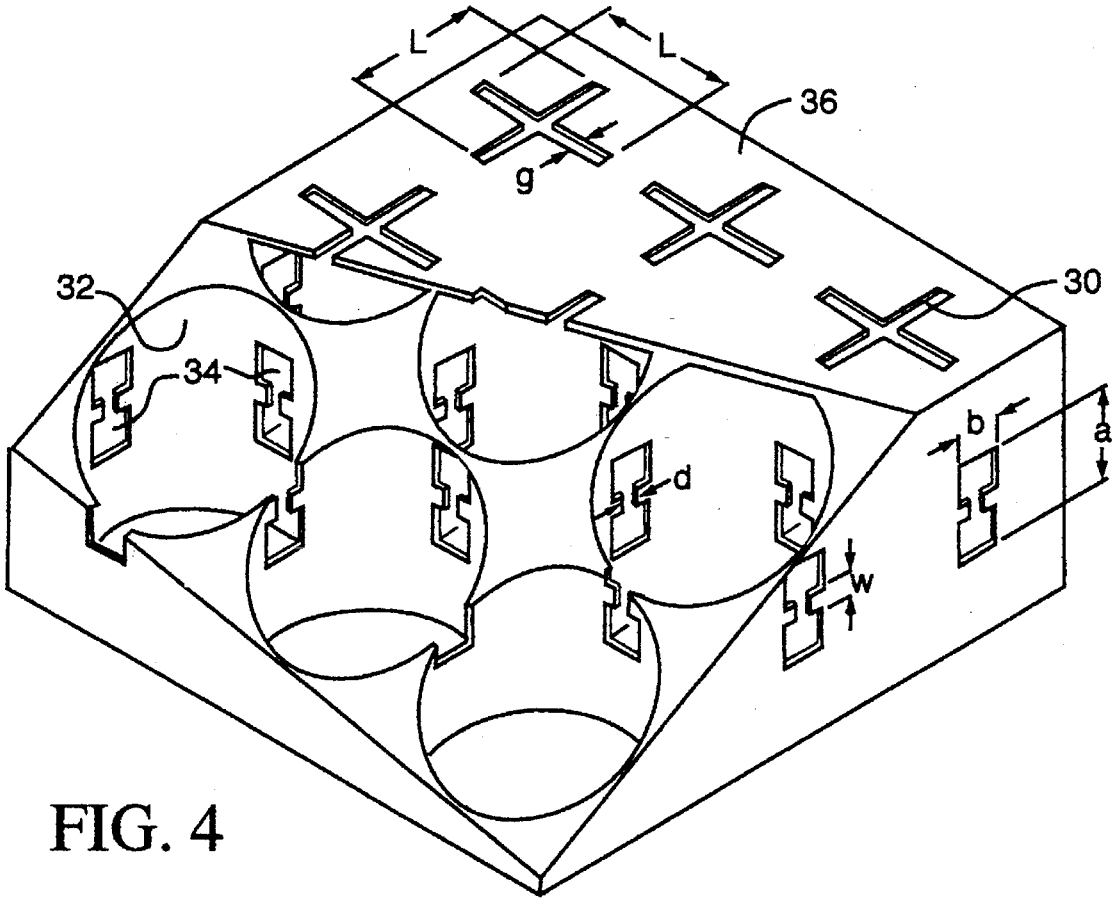
FIG. 4 is a partial cross-section view of a crossed slot, cavity-backed embodiment of this invention.

The embodiment illustrated in FIG. 4 is a partial cross-section of a crossed slot, cavity back embodiment. The sidewall cavity-coupling irises 34, shown in FIG. 4, are resonant on the same frequency of the degenerate $TE_{111}$/$TM_{OIO}$ mode resonance of the slot-backing cavities 32. The coupling irises shown in FIG. 4 are dumbbell-shaped, in order to reduce the linear dimensions of the sidewall openings relative to the physical dimensions of the cylindrical cavities, while attaining the above-specified iris resonant frequency.

This design is particularly suited for application to the conformal arrays of airborn radars.

Such dumbbell-shaped irises may be oriented as in FIG. 4 with the major axis parallel to the axes of the cavities 32, at right-angle to the cavity axes, or at any appropriate intermediate angle to the cavity axes between 0° and 90°. The iris orientation shown in FIG. 4, 0° introduces electromagnetic coupling between the $TE_{111}$ resonant cavity-modes, whereas the iris orientation with the major axis at right angle to the cavity axes, 90°, introduces electromagnetic coupling between the $TM_{OIO}$ resonant cavity-modes. Similarly, any iris orientation at some intermediate angle to the cavity axes, between 0° and 90°, introduces electromagnetic coupling between both the $TE_{111}$ and the $TM_{OIO}$ resonant cavity-modes. The ratio of the two types of couplings (between the $TE_{111}$ and between the $TM_{OIO}$ modes), in the latter case of a 'tilted iris', depends on the value of the 'tilt angle' between the iris major axis and the cylindrical cavity axes. Also, asymmetric (or 'skewed') dumbbell irises can be used to introduce the same type of combined $TE_{111}$/$TM_{OIO}$ mode couplings, with the coupling ratio depending then upon the degree of iris 'asymmetry' (or 'skewing').

The individual antenna array elements 30 are dual polarization crossed slots and the individual unit cells 32 are resonant, multiport, cylindrical $TE_{111}$/$TM_{OIO}$ backing cavities, backing the crossed slots. The cylindrical cavities each have six microwave ports, four cylindrical wall coupling irises 34 and two radiating crossed slots in the top shorting plane 36. Such cavities behave as orthomode microwave hybrids, with little or no coupling between the two sets of 20 diametrically opposed irises. Multiport backing cavities are particularly suited because of:

i. matching the internal resonant field polarizations to the orientation of the corresponding slot elements, ii. having transverse dimensions slightly smaller than the inter element spacings, iii. having a small internal depth, in the order of a free space wavelength, iv. being easily coupled through multiple irises, v. naturally leading to a rigid "engine-block" load bearing electromechanical structure, and vi. being intrinsically high Q, low loss devices.

This last characteristic is essential to achieving a low loss, high efficiency traveling wave feed network.

Figure 5:
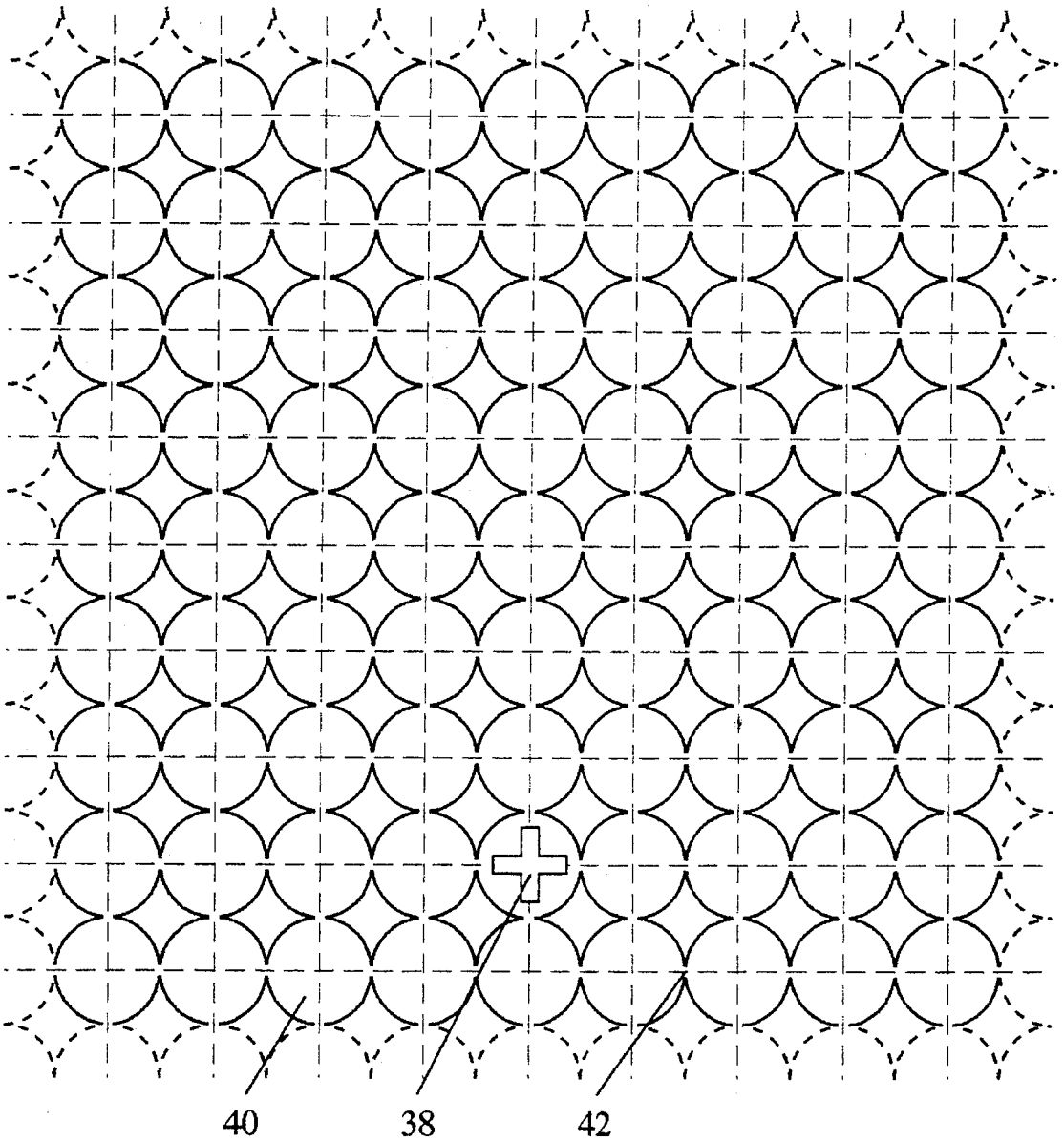
FIG. 5 is a plan view of the cavity and port portions of a more dense version of the embodiment of FIG. 4.
Figure 6:
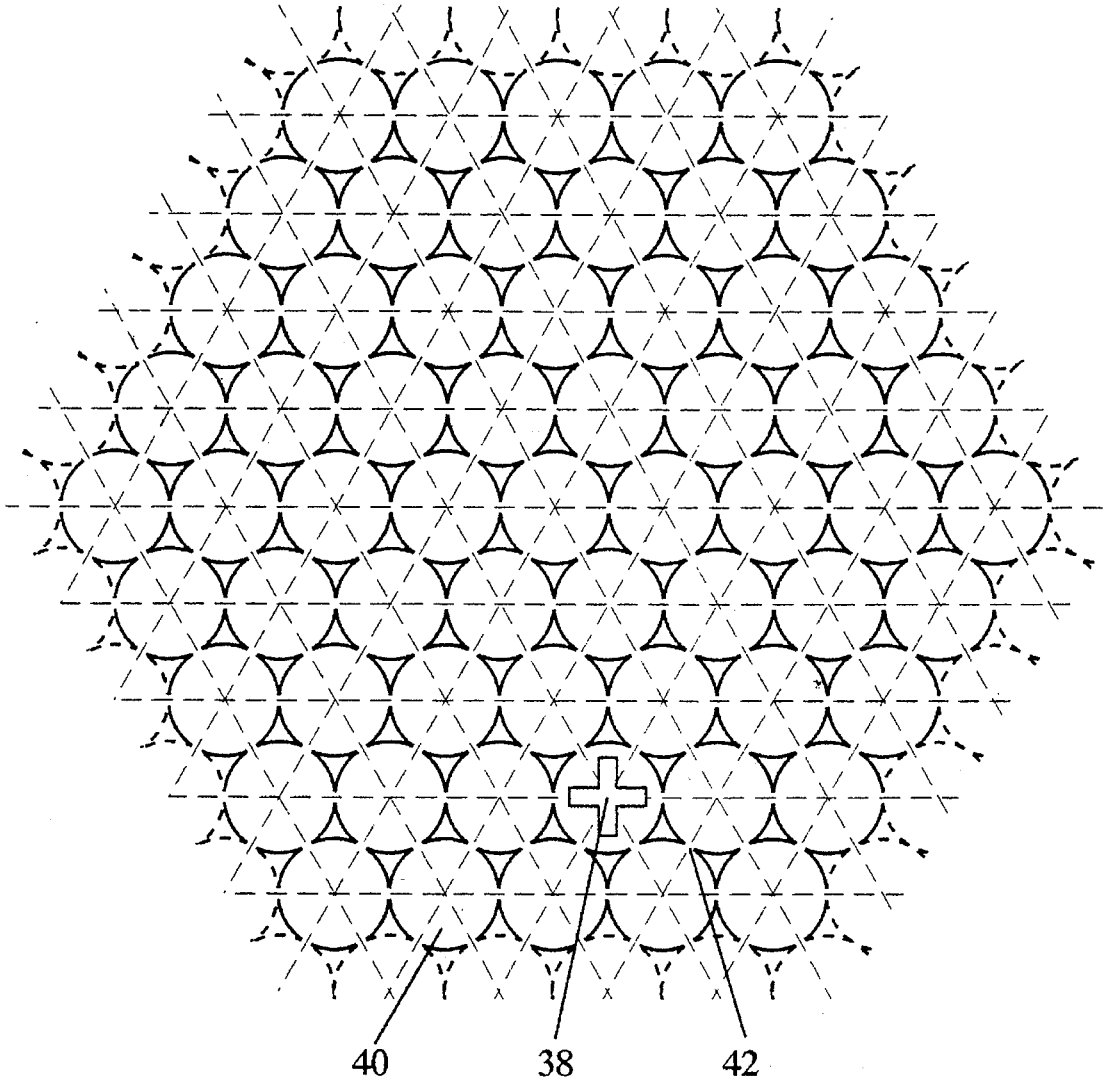
FIG. 6 is a plan view of the above embodiment of this invention showing the coupling means.

Referring to FIGS. 5 and 6, more densely packed arrays are illustrated. As in FIG. 4, the antenna array comprises crossed slots 38 which are resonant cavity backed, but in this embodiment, the cavities 40 each have eight ports 42: two for the crossed slots and six for communicating with their neighboring cavities and, in the case of peripheral cavities, one or two for communicating either with a matching load or an excitation source.

Figure 7:
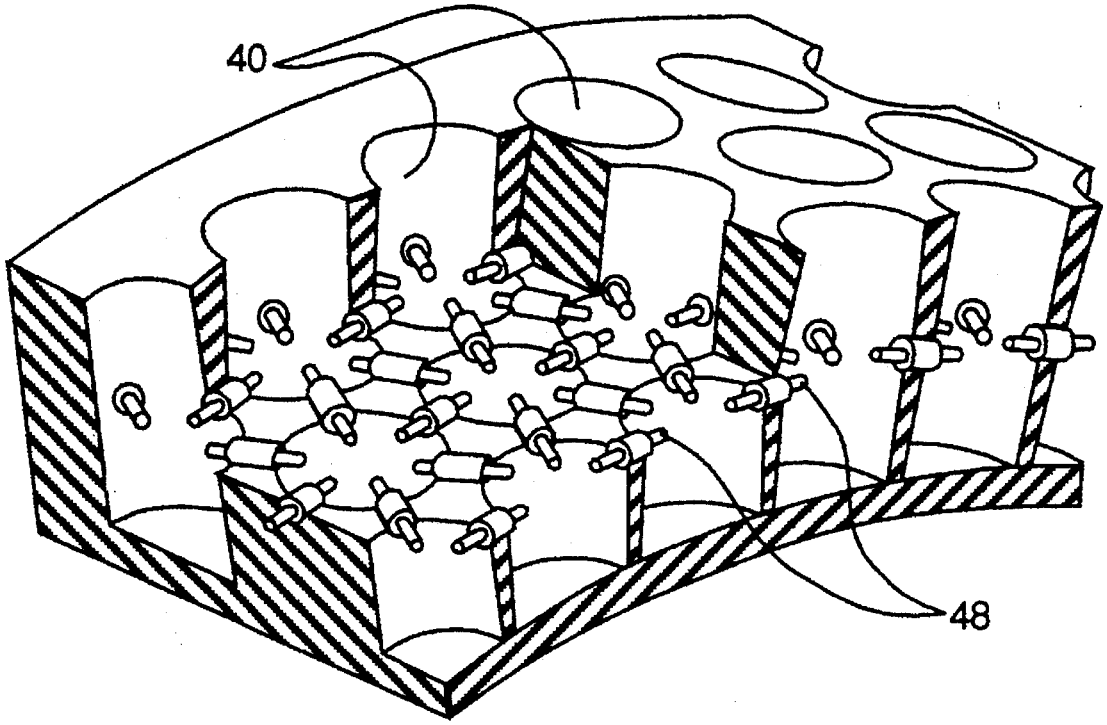
FIG. 7 is a partial cross-section of an embodiment of this invention with cylindrical resonant cavities with probe coupling.

Referring to FIG. 7, a further embodiment of this invention is illustrated. Cylindrical resonant cavities 46 in a conformal structure are shown to be side coupled to their neighbors by means of probes 48, such as coaxial probes.

This invention as illustrated in FIG. 1 is completely general and equally applicable to arrays with different types of elements.

Figure 8:
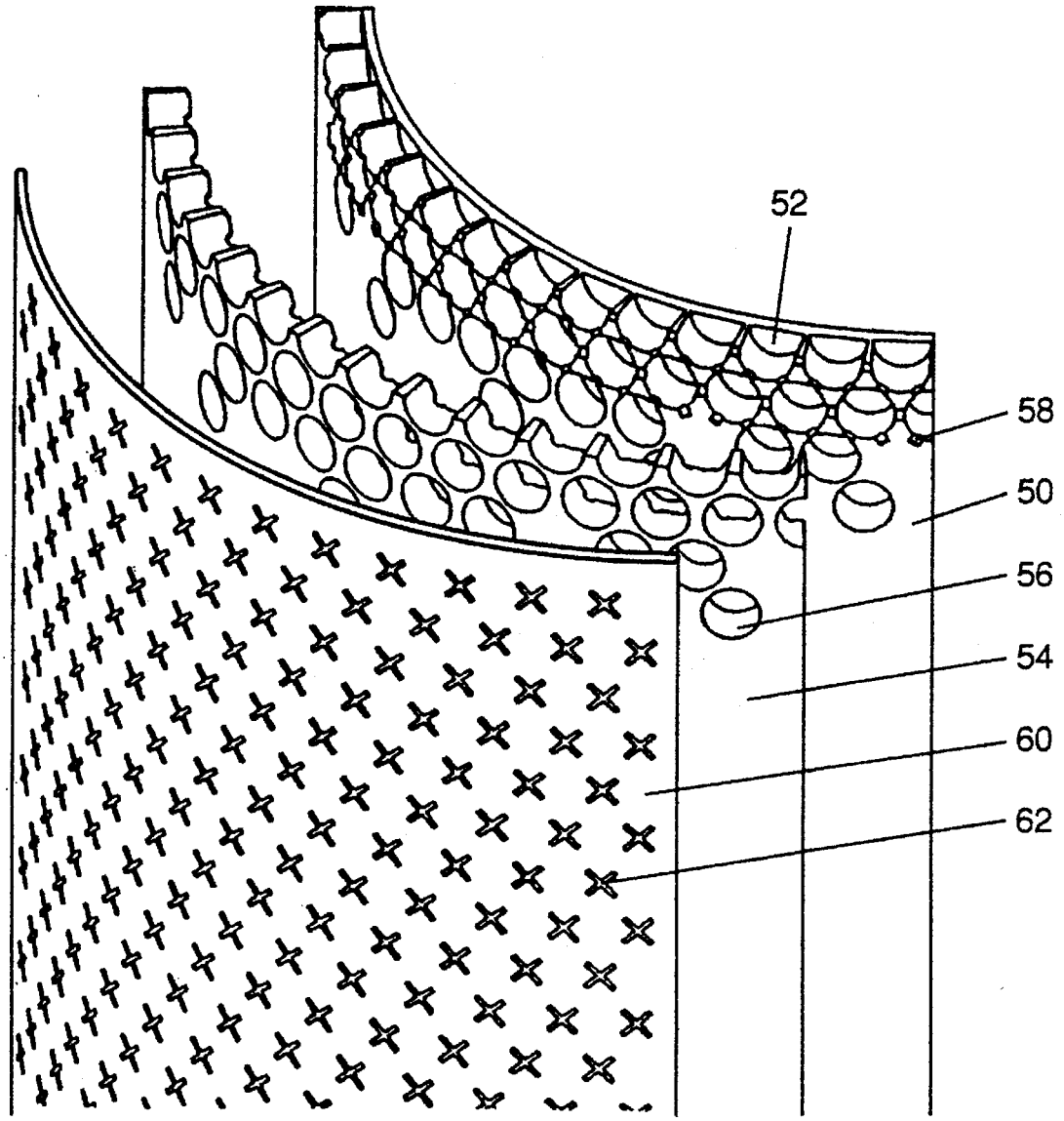
FIG. 8 is an exploded section of a conformal, cavity backed, cross slot array embodiment of this invention.

Referring to FIG. 8, a construction technique for assembling a conformal, cross slot, cavity backed antenna array architecture is illustrated. A first layer 50, comprising depressions 52 which form the base portion of a set of cavities, is shown as a base structure. Applied to the base is a second layer 54 of round holes 56 which form the upper portion of the cavities. The cavities are formed in this manner to facilitate the construction of the side coupling irises 58. The last layer to be applied is a sheet 60 containing the antenna elements, in this case crossed slots 62.

Figure 9:
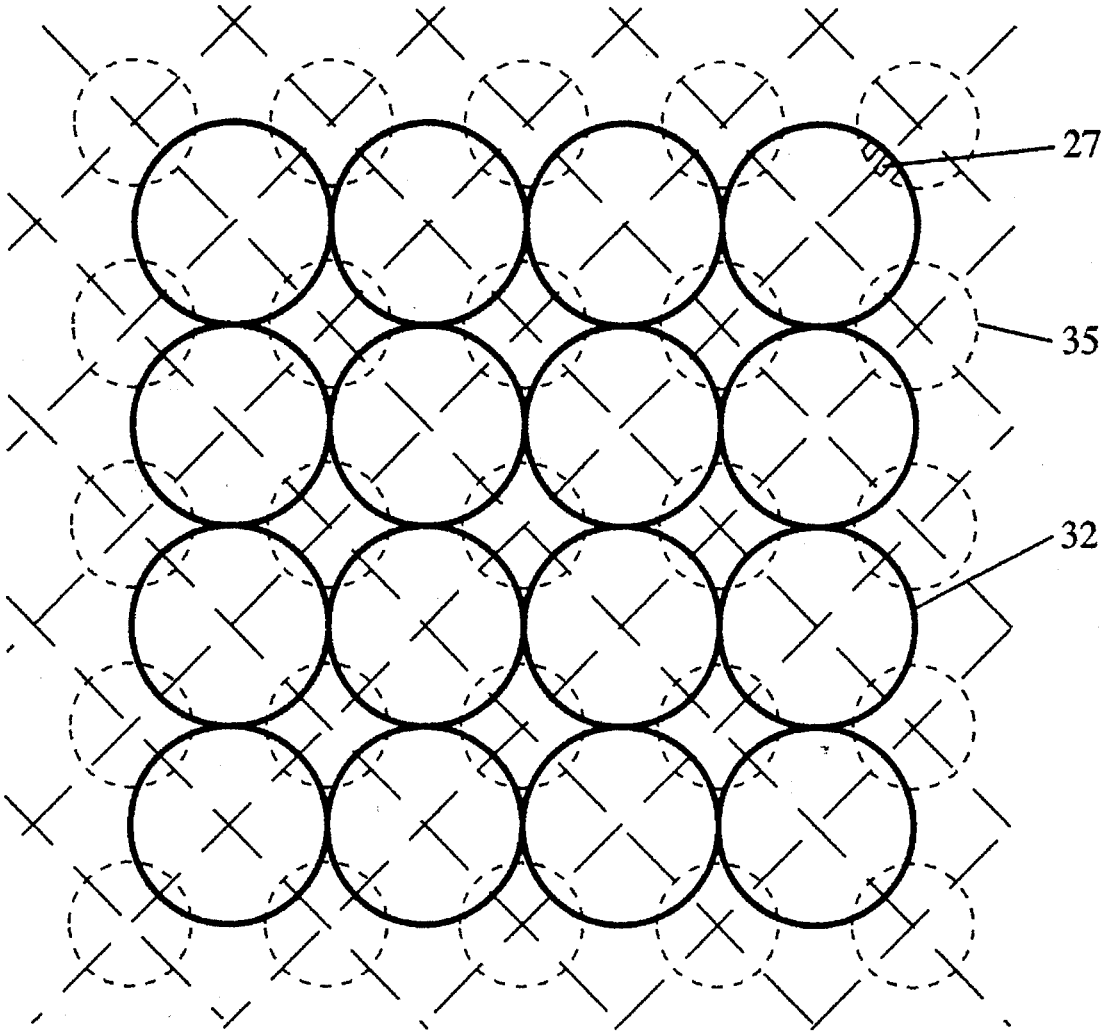
FIG. 9 depicts a square lattice, cavity resonant cluster with four port dielectric coupling.
Figure 10:
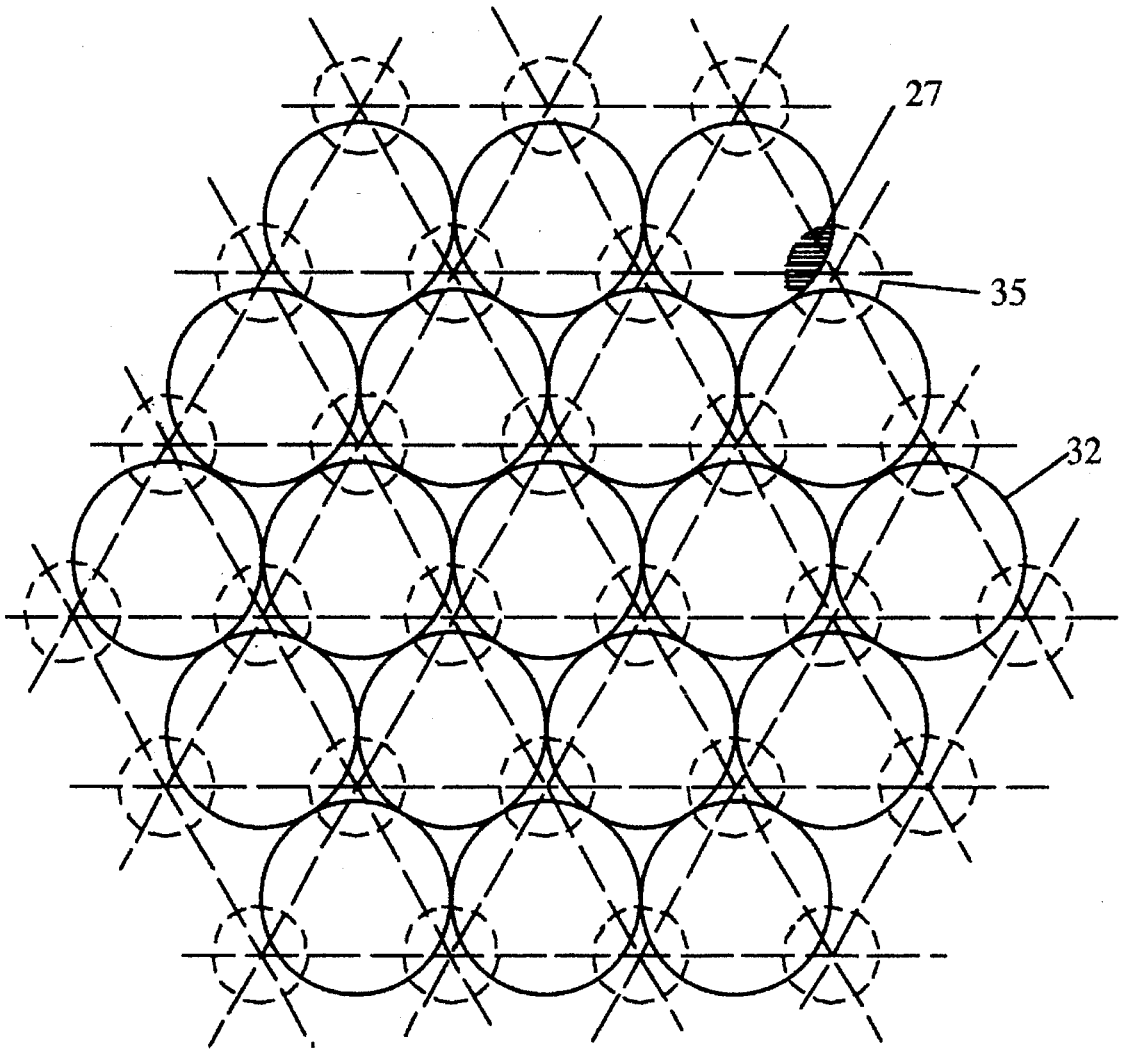
FIG. 10 depicts a triangular lattice, cavity resonant cluster with three port dielectric coupling.
Figure 11:
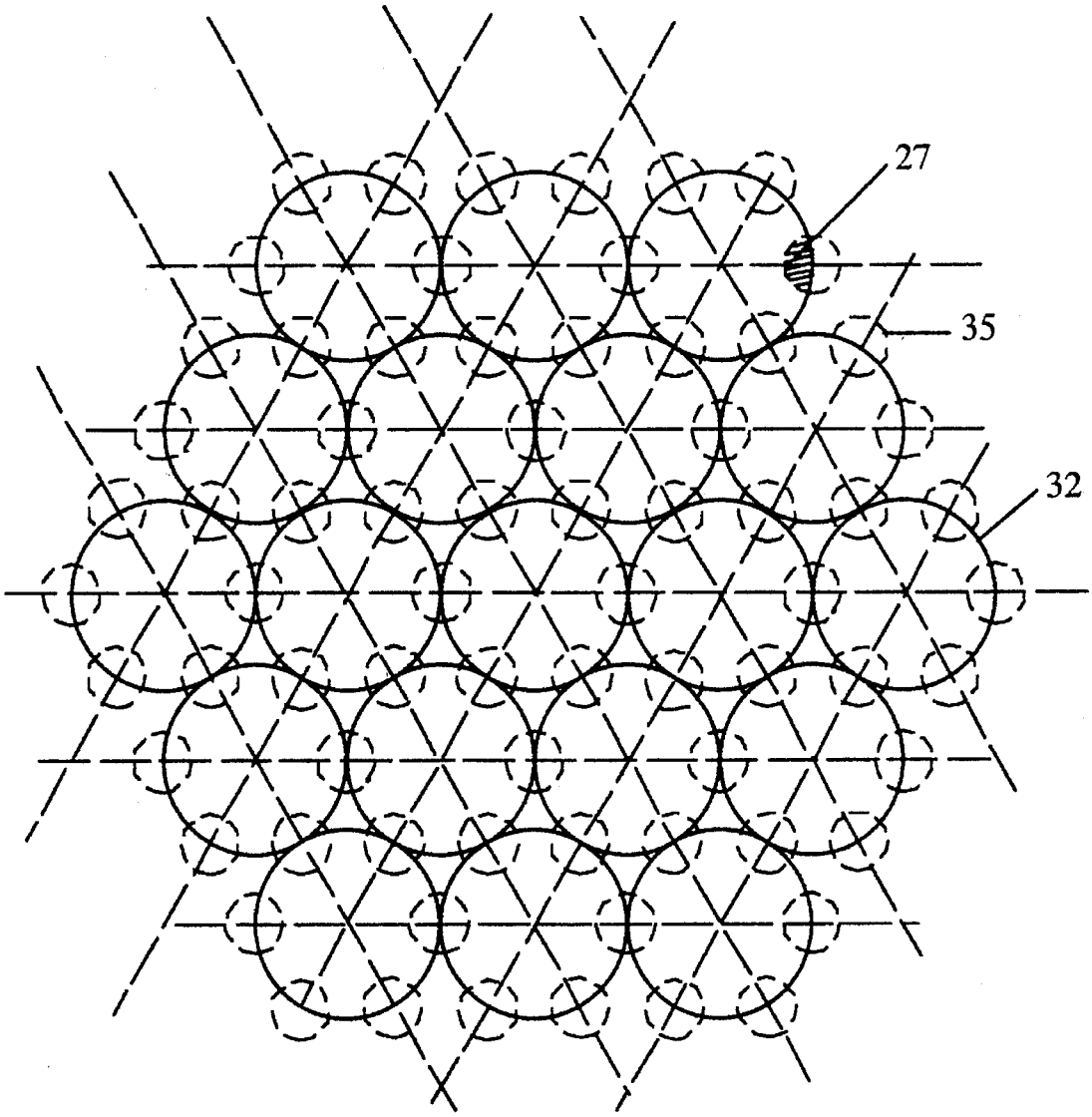
FIG. 11 depicts a hexagonal lattice, cavity resonant cluster with six port dielectric coupling.

FIGS. 9 to 11 illustrate different embodiments of the required cavity-to-cavity sidewall electromagnetic couplings, that constitute an essential feature of the new improved invention. In FIG. 9 the conducting-wall cavities 32 are geometrically ordered as in FIG. 4 and 5 along the rows and columns of a square lattice, but the sidewall coupling irises 35 are rectangular rather than dumbbell-shaped, are smaller and have one of the median axes parallel to the axes of the conducting-wall cavities 32. The rectangular irises 35 are, however, symmetrically located along the diagonal lines of the square lattice that run at 45° to both the rows and the columns. Further, the rectangular irises 35 of FIG. 9 are totally filled by the central regions of cylindrical dielectric resonators 35, with a relative dielectric constant in the order of 4 to 9. The cylindrical dielectric resonators 35 are geometrically and electrically designed to resonate at the frequency of the degenerate $TE_{III}$/$TM_{OIO}$ mode resonance of the conducting-wall cavities 32, while at the same time having an external diameter that is sufficiently large for the dielectric resonators to protrude, by an appropriate penetration depth, into the inner volumes of the four conducting-wall cavity resonators 32 that are immediately adjacent and surrounding the considered dielectric resonator. These geometrical penetrations create four electromagnetic coupling regions 27, where the magnetic field patterns of the two resonator types 32 and 35 partially add, by linear superposition, while at the same time fringing from the coupling region 27 into both the conducting-wall resonators 32 and the dielectric resonators 35.

FIGS. 10 and 11 illustrate two different embodiments of the same concept of sidewall coupling shown in FIG. 4, as applied there to a coupled-cavity cluster with hexagonal lattice. The conducting-wall cavity resonators 32 in FIG. 10 have only three coupling irises each, centrally located between three surrounding resonators 32. The dielectric resonators shown in FIG. 11 need not be all in the same plane, but may be evenly split between two levels, symmetrically displaced from the 'median plane' of the cavity cluster located half-way between the top and bottom shorting planes of the cavities 32, and orthogonal to the cavity axes. In this case, sets of three dielectric resonators, separated by 120° azimuthal angles, must be in the same (upper or lower) offset plane, in order to maintain the rotation symmetry of the single unit-cells, and that of the whole cavity cluster.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A phased array antenna architecture comprising:

a two-dimensional array of antenna elements configured in a lattice, all antenna elements being similarly oriented to form a two-dimensional antenna aperture surface;

an array of unit cells configured in a lattice structure which matches, at least in number and form, the layer of the antenna elements and which is physically coextensive therewith as a backplane, each unit cell comprising:

at least one means for delaying the phase of an electromagnetic wave passing therethrough; and means for electromagnetically coupling each unit cell to a uniquely corresponding antenna element;

means for electromagnetically coupling each unit cell to each of its immediately neighboring unit cells;

means for terminating the backplane peripheral unit cells which are not being excited with a matching impedance; and means external to the backplane for providing electromagnetic excitation, the amplitude and phase of which have been selectively adjusted at input ports defined by a set of backplane peripheral unit cells of said array of unit cells, whereby said electromagnetic wave is configured to form a desired waveform at said antenna aperture.

2. In a two dimensional antenna array excited by guided traveling waves through an underlying matrix delay structure which is fed via a plurality of peripheral input ports, a method of electronic beam steering comprising the steps of:

adjusting the amplitude of the excitation signals at one or more selected peripheral input ports; and adjusting the electronically controlled phase shifters associated with the selected input ports so as to progressively phase the excitation.

3. In a two dimensional antenna array excited by guided traveling waves through an underlying isotropic matrix delay structure comprising a plurality of delay modules, each coupled to all adjacent delay modules, said delay structure being fed via a plurality of peripheral input ports, a method of electronic beam steering in a plane orthogonal to the array aperture surface comprising the steps of:

selecting one or more peripheral input input ports for excitation;

phasing the excitation in a progressive manner;

adjusting the amplitude of the excitation at the input ports; and controlling the incremental phase shift of the array excitation waves traversing the delay structure by means of selectively controlling at least one variable selected from the group consisting of:

selecting the array operating frequency;

changing the back plane unit-cell resonant frequency; and adjusting the mutual coupling between adjacent unit-cells.

4. A phased array antenna for transmitting/receiving an electromagnetic beam in which said electromagnetic beam is steerable in any direction orthogonal to an aperture of said antenna, said antenna comprising:

an array of antenna elements configured in a two-dimensional lattice;

an array of unit cells configured in a two-dimensional lattice comprising rows and columns and having a periphery, one unit cell corresponding to each antenna element, each unit cell inducing a phase delay in an excitation wave traveling through said array of unit cells;

a first plurality of couplers for coupling each unit cell to its corresponding antenna element;

a second plurality of couplers for coupling said each unit cell to all adjacent cells;

a plurality of exicitation phase shifters disposed at a each said peripheral row and associated peripheral column;

a plurality of excitation amplitude controllers disposed at each said row and associated peripheral column; and a plurality of terminating loads disposed at a second peripheral row and a second peripheral column, wherein said excitation wave introduced into said first peripheral row or said first peripheral column travels through said array of unit cells towards said second peripheral row or said second peripheral column.

5. A phased array antenna as in claim 4 wherein all antenna elements of said array of antenna elements are similarly oriented.

6. A phased array antenna as in claim 4 wherein each said antenna element comprises a dipole.

7. A phased array antenna as in claim 4 wherein each said antenna element comprises a crossed-slot.

8. A phased array antenna as in claim 7 wherein each said cross-slot antenna element has a dual polarization.

9. A phased array antenna as in claim 4 wherein said each unit cell comprises a multi-port backing cavity.

10. A phased array antenna as in claim 9 wherein said each unit cell comprises a cylindrical resonant cavity.

11. A phased array antenna as in claim 10 wherein said second plurality of couplers comprise dielectric resonators.

12. A phased array antenna as in claim 11 wherein each said cylindrical resonant cavity couples to a plurality of said dielectric resonators.

13. A phased array antenna as in claim 12 wherein each said cylindrical resonant cavity couples to three said dielectric resonators.

14. A phased array antenna as in claim 12 wherein each said cylindrical resonant cavity couples to four said dielectric resonators.

15. A phased array antenna as in claim 12 wherein each said cylindrical resonant cavity couples to six said dielectric resonators.

16. A phased array antenna as in claim 10 wherein each said second plurality of couplers are probes.

17. A phased array antenna as in claim 10 wherein each said second plurality of couplers comprises sidewall coupling irises.

18. A phased array antenna as in claim 17 wherein each said sidewall coupling iris is dumbbell-shaped.

19. A phased array antenna as in claim 17 wherein each said sidewall coupling iris has a rectangular shape.

20. A method of electronic beam steering in a phased array antenna, said method comprising:

connecting each antenna element of an array of antenna elements having a radiating aperture to a corresponding unit cell of an array of unit cells that constitute an underlying matrix delay structure, each said unit cell being connected to all adjacent cells;

locating said matrix delay structure on a two-dimensional surface parallel to the array radiating aperture;

selecting a two-dimensional set of peripheral input ports of said array of unit cells;

introducing an excitation wave through the selected set of peripheral input ports;

adjusting the amplitude of said excitation wave;

shifting the phase of said excitation wave progressively; and propagating said excitation wave through said array of unit cells to said corresponding array of antenna elements.

* * * * *